US007286681B2

(12) United States Patent
Gerkinsmeyer

(10) Patent No.: US 7,286,681 B2
(45) Date of Patent: Oct. 23, 2007

(54) LOUDSPEAKER

(75) Inventor: Norman Gerkinsmeyer, Germany (DE)

(73) Assignee: IST GmbH, Guenzberg (DE)

( * ) Notice: Subject to any disclaimer, the term of this patent is extended or adjusted under 35 U.S.C. 154(b) by 0 days.

(21) Appl. No.: 10/542,521

(22) PCT Filed: Nov. 11, 2003

(86) PCT No.: PCT/EP03/12940

§ 371 (c)(1),
(2), (4) Date: May 8, 2006

(87) PCT Pub. No.: WO2004/068898

PCT Pub. Date: Aug. 12, 2004

(65) Prior Publication Data

US 2007/0009133 A1 Jan. 11, 2007

(30) Foreign Application Priority Data

Jan. 25, 2003 (DE) ..... 103 03 030

(51) Int. Cl.
*H04R 25/00* (2006.01)

(52) U.S. Cl. ..... 381/430; 381/398

(58) Field of Classification Search ..... 381/396, 381/398, 403, 407, 412, 423, 424, 430, 433, 381/152; 181/171–173, 199
See application file for complete search history.

(56) References Cited

U.S. PATENT DOCUMENTS 6,154,556 A * 11/2000 Takahashi et al. ..... 381/430
7,088,842 B2 * 8/2006 Hikichi ..... 381/430
7,167,573 B2 * 1/2007 Williamson ..... 381/403

* cited by examiner

*Primary Examiner*—Huyen Le
(74) *Attorney, Agent, or Firm*—Dort Patent, P.C.; David Dort

(57) ABSTRACT

The invention relates to a loudspeaker comprising at least one magnet (5), a membrane (2) with an outer edge (32) defining an outer edge plane (30) of the membrane, a bead (3) surrounding the membrane (2), a moving coil (9) which is fixed to the first membrane (2), and a magnet system (4) comprising at least one magnet (9). The loudspeaker also has a supporting structure (1) for receiving the magnet system (4) and the membrane, the membrane being connected to the supporting structure by means of the bead, and the supporting structure has a front side which is oriented towards the membrane and a rear side which is oriented in the opposite direction. The membrane (2) is at least partially convex towards the front, in the predominant acoustic direction (33), and the region (28) of the membrane (2), to which the moving coil is fixed, is arranged in front of the outer edge plane (30) of the membrane. The diameter (D) of the membrane (2) is larger than the diameter of the moving coil (d) which moves the membrane (2).

29 Claims, 7 Drawing Sheets

LOUDSPEAKER

Figure 1:
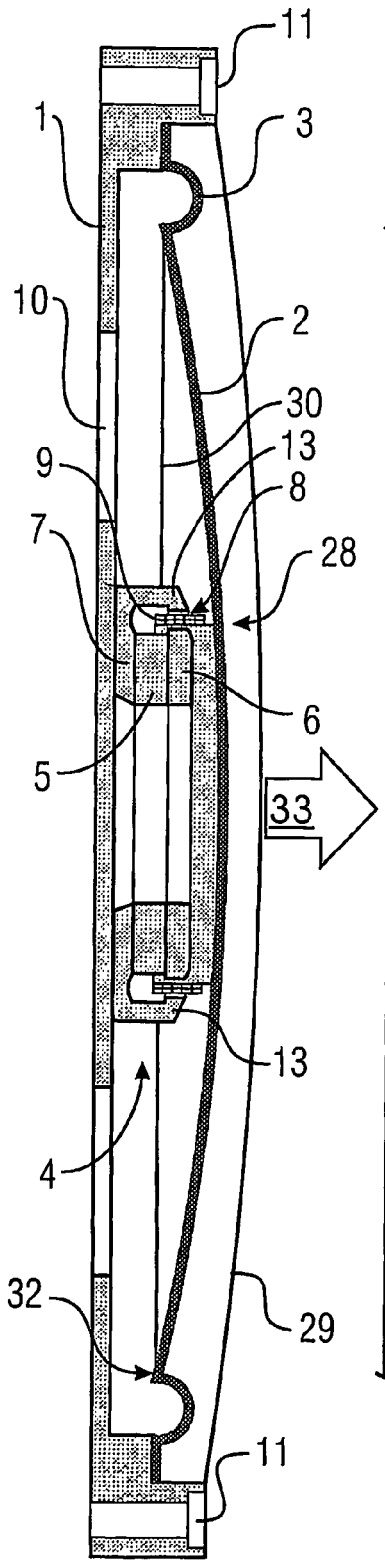

The invention relates to a speaker that is embodied as an electrodynamic sound converter, having at least one first magnet, a first membrane with a membrane outer edge that spans a membrane outer edge plane, a first crimp running around the first membrane for flexible mounting of the first membrane, a first vibration coil that is directly or indirectly attached to the first membrane, and a magnet system with at least one first magnet, furthermore having a carrying construction (basket) for housing the magnet system and the first membrane, with the first membrane being connected to the carrying construction by way of the first crimp and with the carrying construction having a front side oriented toward the membrane and a rear side oriented in the opposite direction.

Similar speakers are generally known. We refer by way of example to German Patent Application DE 36 03 537 A1. This document discloses a broadband speaker with a membrane that is activated by a vibration coil and a permanent magnet, with the membrane having a circumferential crimp on its outer edge by means of which the membrane is flexibly mounted. The crimp is fastened to a carrying construction, also referred to as a basket, with the carrying construction also being used for holding the entire centrically disposed magnet system. Here, therefore, the membrane is formed opposite the preferred sound direction of the speaker and forms a sort of funnel on whose tip the magnet system is disposed such that a large installation depth is necessary overall due to the basket of the speaker and the magnet system located outside the basket.

Because of today's demand for problem-free installation options for speakers, for example, in the automotive or aviation industries, however, speakers are required to be as flat and have as little bulk as possible and to be able to be attached to even the most planar surfaces, for example, vehicle doors or frames, without any special preparation. Modern vehicle doors are usually kept very flat and have a large number of cable loops and electrical systems that fill the available space and hollow areas to a large extent. In addition, the guidance and mechanisms for windows and locking mechanisms as well as cross beams for side impact air bags and the like frequently require large amounts of space, so that it becomes very difficult to install a speaker there as well.

As an alternative, it is also possible for the speakers to be installed in other places, for example, in the foot space or control panel. However, these options are associated with fundamental space problems as well; whereby the acoustic quality suffers also severely due to unfavorable positioning.

There are various flat speaker systems currently on the market built according to other construction principles; however, these systems frequently have too low an efficiency rating and too small a frequency range. Moreover, they have a high degree of mechanical susceptibility and no temperature resistance or temperature-dependent acoustic behavior.

We further refer to German Patent No. DE 36 38 727 C2, which discloses a compact dynamic speaker that is already quite developed; however, in this embodiment, the acoustic quality is hindered by the fact that, in the region of the preferred sound projection, the magnet system is attached in front of the membrane and therefore is an obstacle to the unimpeded projection of sound. Moreover, a stable and fastening of the magnet system is made more difficult because a compromise must be reached between the stability of the mount for the magnet and free sound projection.

The object of the present invention is to introduce a speaker that, on the one hand, operates according to the proven and simple system of electrodynamic sound conversion with a permanent magnet and vibration coil, but on the other hand, fulfills modern demands for flat construction and high acoustic quality.

This object is attained by the features of claim 1. Advantageous embodiments of the invention are found in the subclaims and drawings as well as in the specification.

The inventor realized that a solution to the problem mentioned above could be attained by equipping the speaker with a membrane that is arced in the preferred sound projection direction, that is activated by a vibration coil and magnet, with the magnet system at least partially protruding into the volume spanned by the membrane, whereby a very flat embodiment of the carrying construction or basket is attained. Here, a magnet system with at least one permanent magnet is used that forms an annular gap, optionally with the aid of a yoke or another magnet, with the vibration coil being able to extend into this annular gap. The magnet system can thus be moved very close to the membrane such that the surface of the outer edge of the membrane formed by the outer edge of the membrane is divided by the magnet system. On the one hand, this produces an extremely flat construction of the magnet. On the other hand, a very good and broadband acoustical characteristic of the speaker system is attained.

On the basis of these fundamental considerations, the inventor suggests the speaker, which is known per se, comprising:

one first magnet, one first membrane with one membrane outer edge that spans a membrane outer edge plane, a first crimp running around the circumference of the first membrane for the flexible mounting of the first membrane, a first vibration coil that is directly or indirectly attached to the first membrane, and a magnet system with at least one first magnet (permanent magnet), and furthermore a carrying construction (basket) for housing the first magnet system and the first membrane, with the first membrane being connected to the carrying construction by way of the first crimp and with the carrying construction having a front side oriented toward the membrane (sound projection direction) and a rear side oriented in the opposite direction, to be improved in that the first membrane is constructed at least partially upwardly convex and in that the region of the first membrane, to which the first vibration coil is attached, is disposed in front of the plane of the outer edge of the membrane, and in that the first membrane has a diameter that is greater than the diameter of the first vibration coil that moves this membrane This construction achieves an extremely flat and also compact embodiment of the speaker system, such that it is particularly suitable for installation in automobiles. However, other applications that also require a flat embodiment of a speaker system are possible as well.

In a particularly preferred embodiment of the speaker, the inventor suggests that the magnet system at least intersect the plane of the outer edge of the membrane or, optionally, even be arranged above the plane of the outer edge of the membrane. This means, therefore, that the magnet system will be located at least partially inside the volume spanned by the membrane.

The magnet system may preferably have a first annular groove into which the vibration coil can extend. This allows for particularly good guidance. If the vibration coil is sufficiently large, this allows for a better stabilization of the natural vibration behavior of the membrane and the membrane can be made very flat and thin. This increases the efficiency of the system and the lift of the membrane can be reduced.

In a further variation of the speaker, additional provision may be made for at least one other membrane to be disposed inside the first membrane so that a multipath system can be created hereby. Here, in addition, the magnet system may have at least one additional annular groove into which an additional vibration coil for an additional membrane may extend.

The first membrane may also have another crimp located on the inside that is connected to the magnet system such that an additional centering of the membrane is achieved thereby.

The membrane may also have a multi-part construction. This has the advantage that the central region may be produced using other, lighter materials, such that improved dynamics are achieved at higher frequencies.

In this manner and by a corresponding structure of the magnet system, it is possible for the speaker to be structured not only as a single-path system, but also as a two-, three-, or multi-path system.

Another advantageous embodiment of the speaker may lie in the magnet system having at least one toric magnet and at least one pole flange that form the at least one air gap.

Moreover, it is possible for the magnet system to be comprised of several toric magnets, one lower pole flange, and one upper pole flange per magnet, with the air gaps being disposed between the pole flanges. This structure of the magnet system allows for a very effective multi-path system, with the inner annular groove being provided for the operation of a tweeter.

Even though it is also possible to omit special centering devices in the speaker according to the invention, it is still advantageous in certain cases, in particular if the size of the structure requires an additional centering device. The magnets of the magnet system may be surrounded in the shape of a ring by their respective vibration coils.

Moreover, it may be advantageous for the pole flanges of the magnet system to be produced from a magnetic material because this allows a high flux density with well-defined field lines to be produced in the region of the air gap.

In a special embodiment, the magnet system can be structured in such a way that a toric magnet is, at the same time, disposed inside a larger vibration coil and outside a smaller vibration coil. Here, it is particularly advantageous for the rear pole flange to be embodied as a magnetic yoke so that a narrow air gap is formed by the front and rear pole flanges, both inside and outside the toric magnet.

The materials for the permanent magnet may be from different variants. However, Neodym iron or Neodym iron-boron or rare earth cobalt ($SmCo_5$ or $Sm_2Co_{17}$) or other hard ferrites are particularly advantageous.

With regard to the structure of the speaker, the inventor recommends that at least one magnet be attached to the membrane basket by a screw and/or glue and/or clamping elements; combinations of these fastening options are recommended as well.

With regard to the structure of the membrane, the inventor suggests that the membrane be composed of, for example, a foam material that is preferably provided with a single- or double-sided blocking layer. For example, this material could be aluminum and magnesium foam, hard polystyrol foam, PVC, polyolefin, polyurethane, polyester, Styrofoam, or sandwich plates with a honeycomb structure.

Another variation of the structure of the membrane or part of the membrane may be for it to be produced from a formed film or sandwich product, preferably polyester, polyimide, bextrenes, polycarbonate, aluminum, magnesium, polypropylene, paper, fibrous materials, Kevlar, carbon fibers, glass fibers, Nomex, or mixed products of the materials mentioned above.

In addition, an inversely formed dust cap, also known as a dome, cone, or anti-dust cone, may be disposed on at least one membrane, preferably the only membrane.

The minimum of one crimp provided may be made, for example, from rubber or coated foam material, fibrous materials, or paper.

The "dust cap" mentioned above may be attached in the central region of a membrane; a centering device, for example, made of spring steel or fibrous materials, may be located behind it.

With regard to the carrying construction or basket, the inventor recommends that it be produced from plastics or metallic materials; it is advantageous for the basket to be provided with openings in order to allow for physical connection to the rear air supply of a casing or housing that may be present.

For example, the rear of the basket may be embodied as a flat plane such that no openings for installation are necessary behind the speaker. However, there is also the possibility of embodying the rear of the basket as the flat base of a cone, preferably with a maximum slope of 20°, preferably a maximum slope of 10° to the level.

Moreover, in order to protect the membrane, a protective grate can be arranged in front of the membrane, as is generally known from prior art.

With regard to the size ratios of the speaker in a preferred embodiment, the inventor recommends that the ratio of B:T of the largest width B of the largest membrane of the speaker to the greatest depth T of the speaker construction with regard to the membrane and magnet system components be greater than 3:1, preferably greater than 5:1, preferably greater than 10:1.

Figure 2:
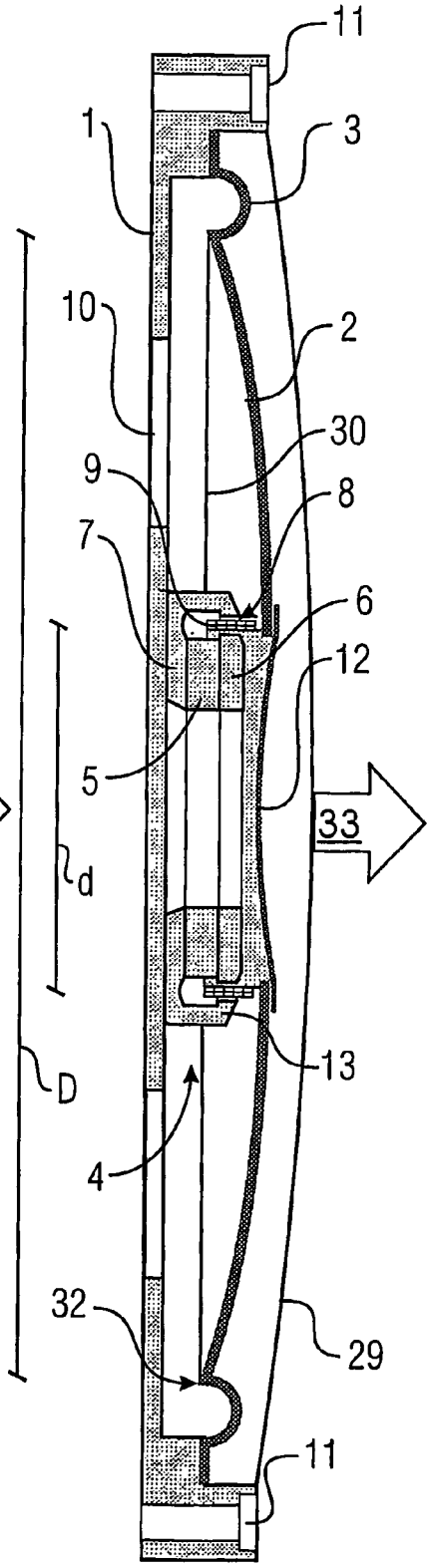
Figure 3:
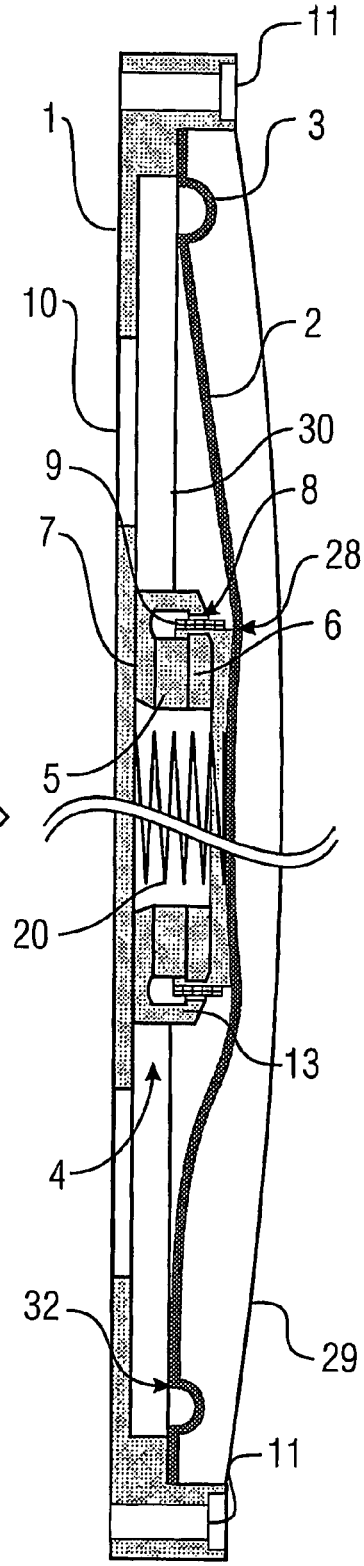
Figure 4:
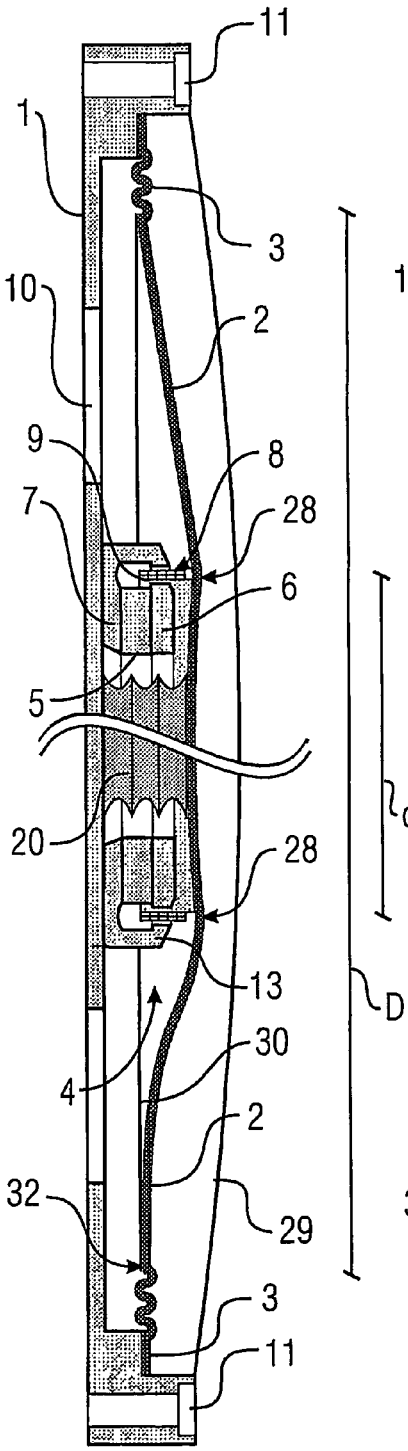
Figure 5:
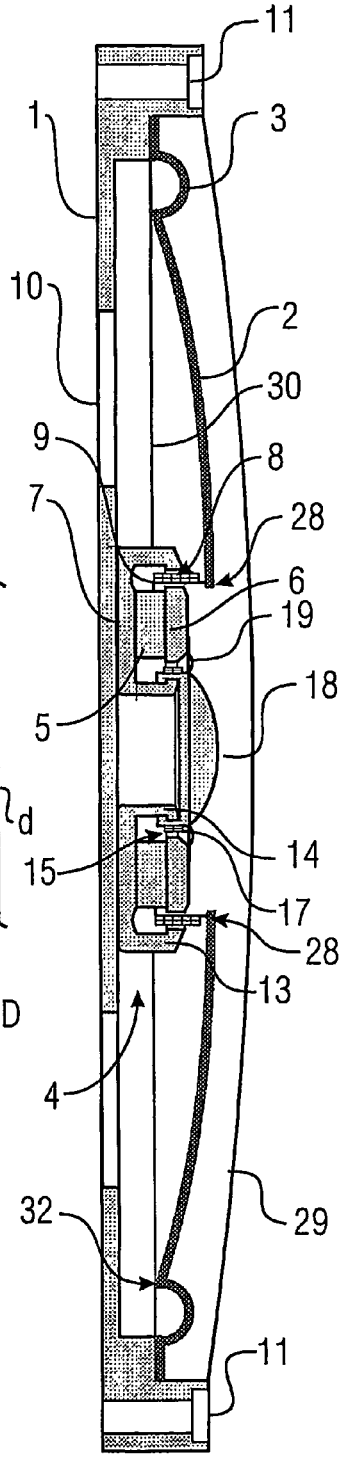
Figure 6:
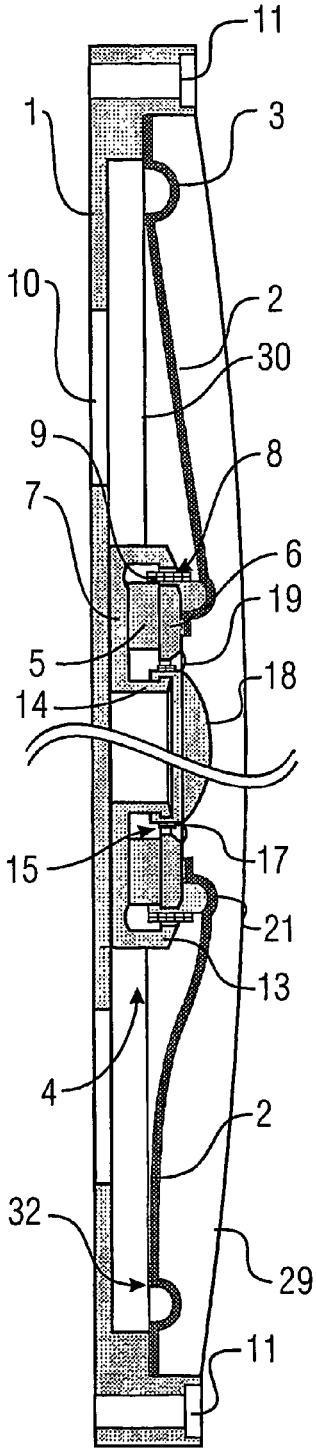
Figure 7:
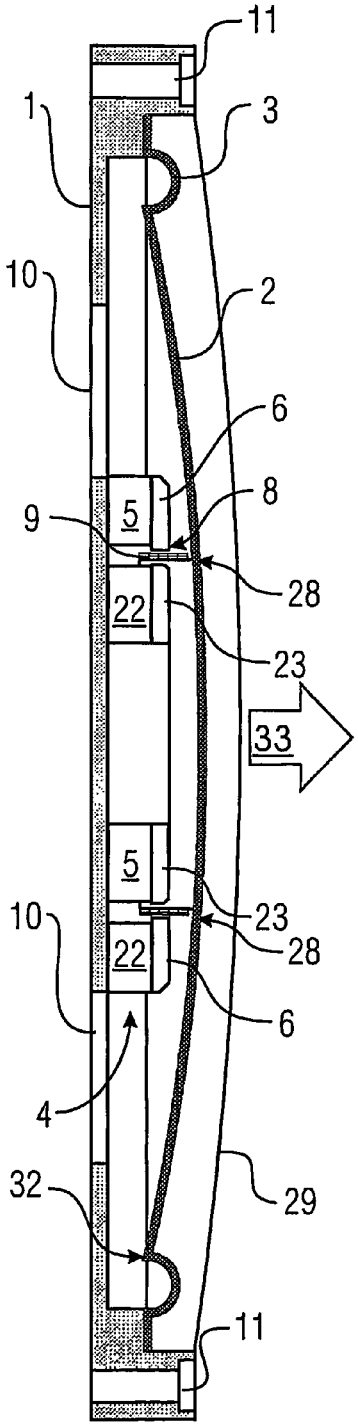
Figure 8:
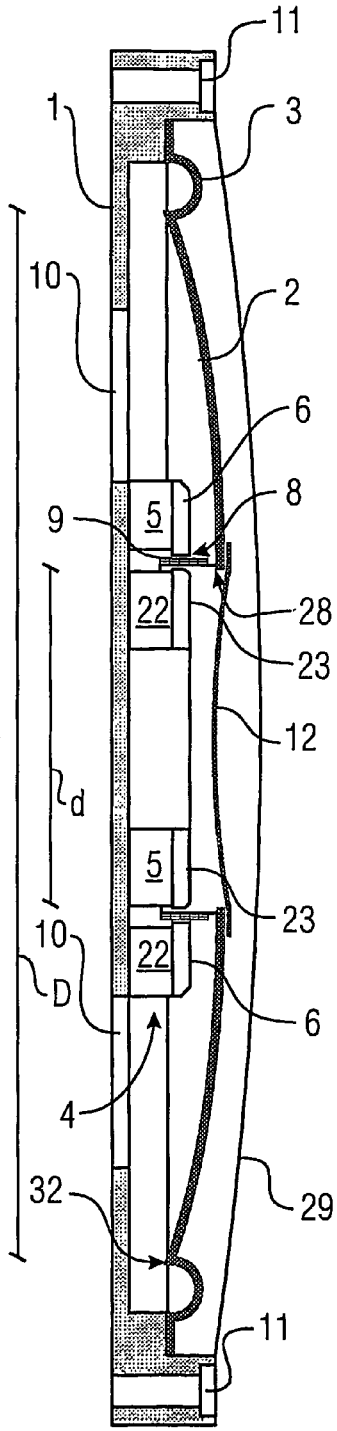
Figure 9:
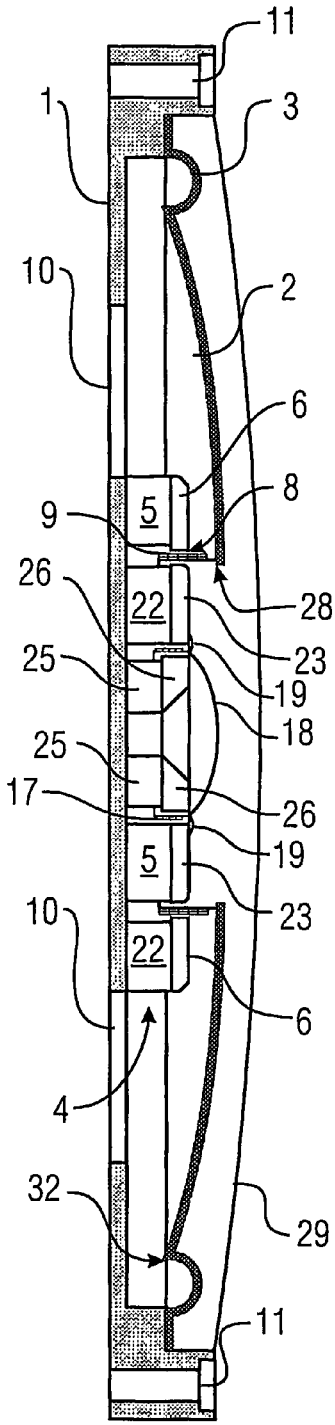
Figure 10:
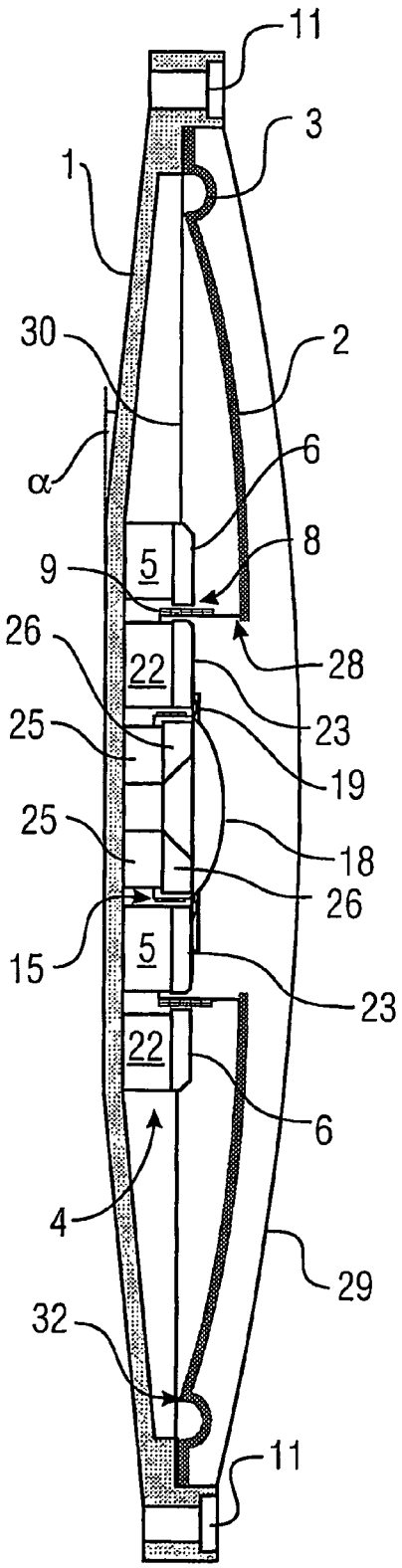
Figure 11:
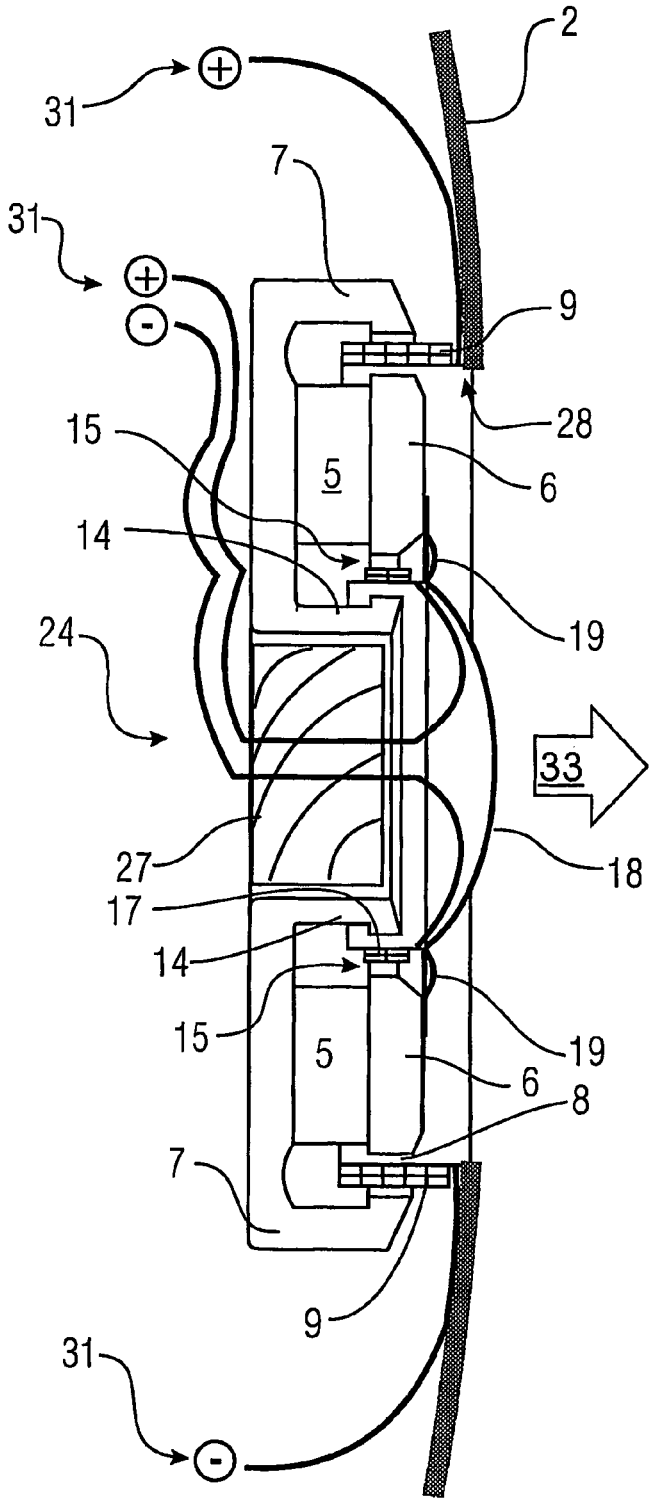
Figure 12:
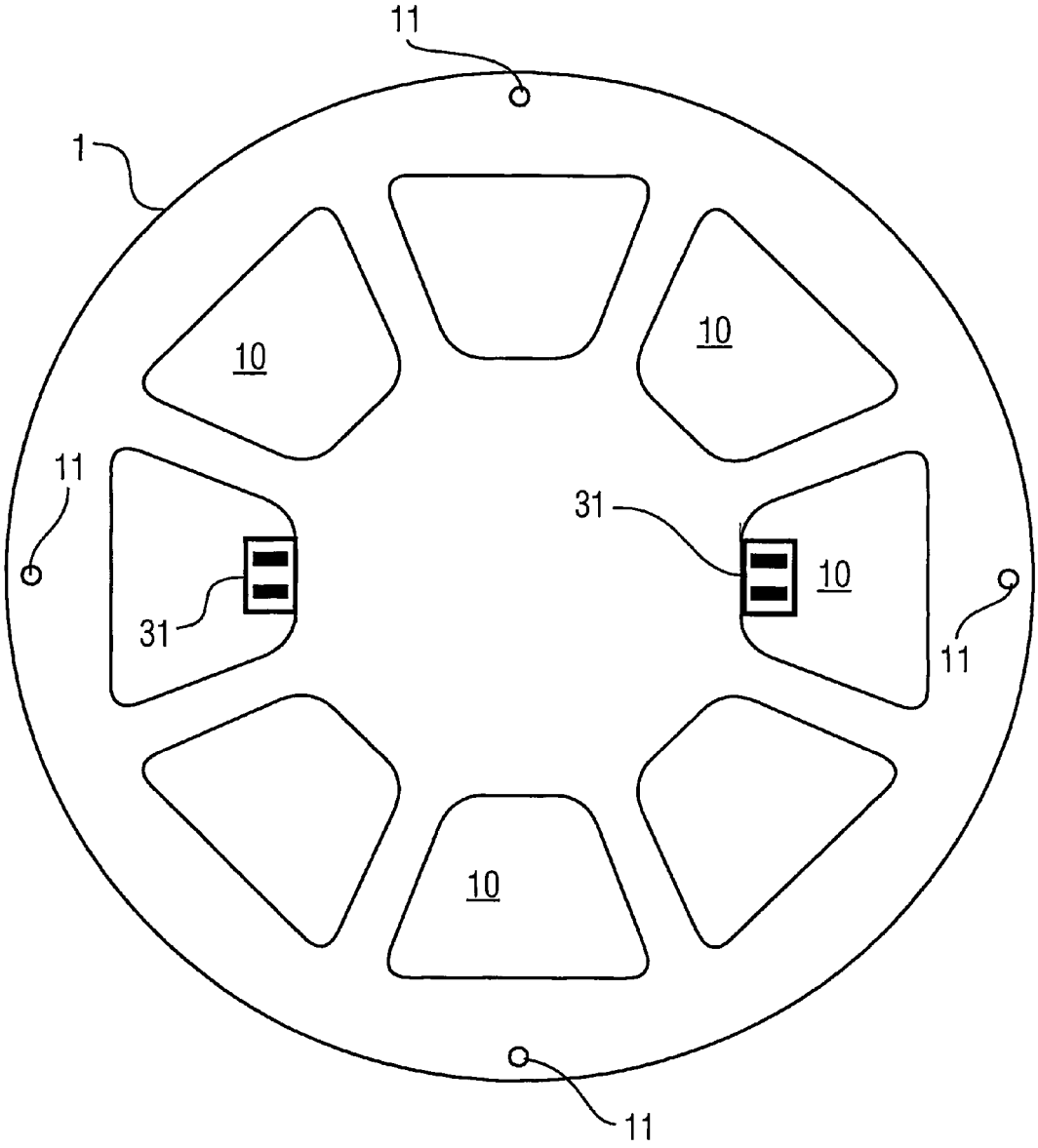
Figure 13:
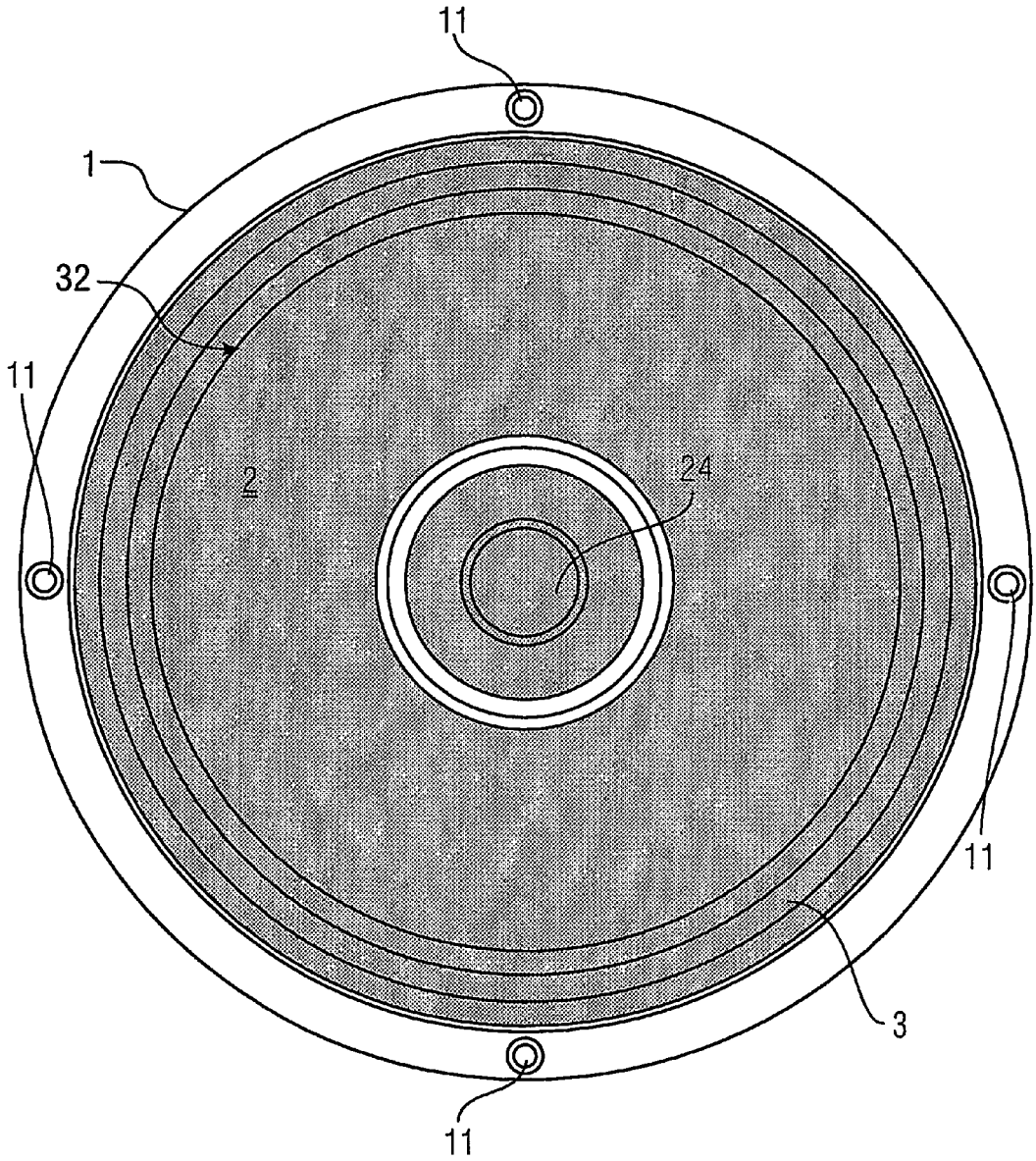
Figure 14:
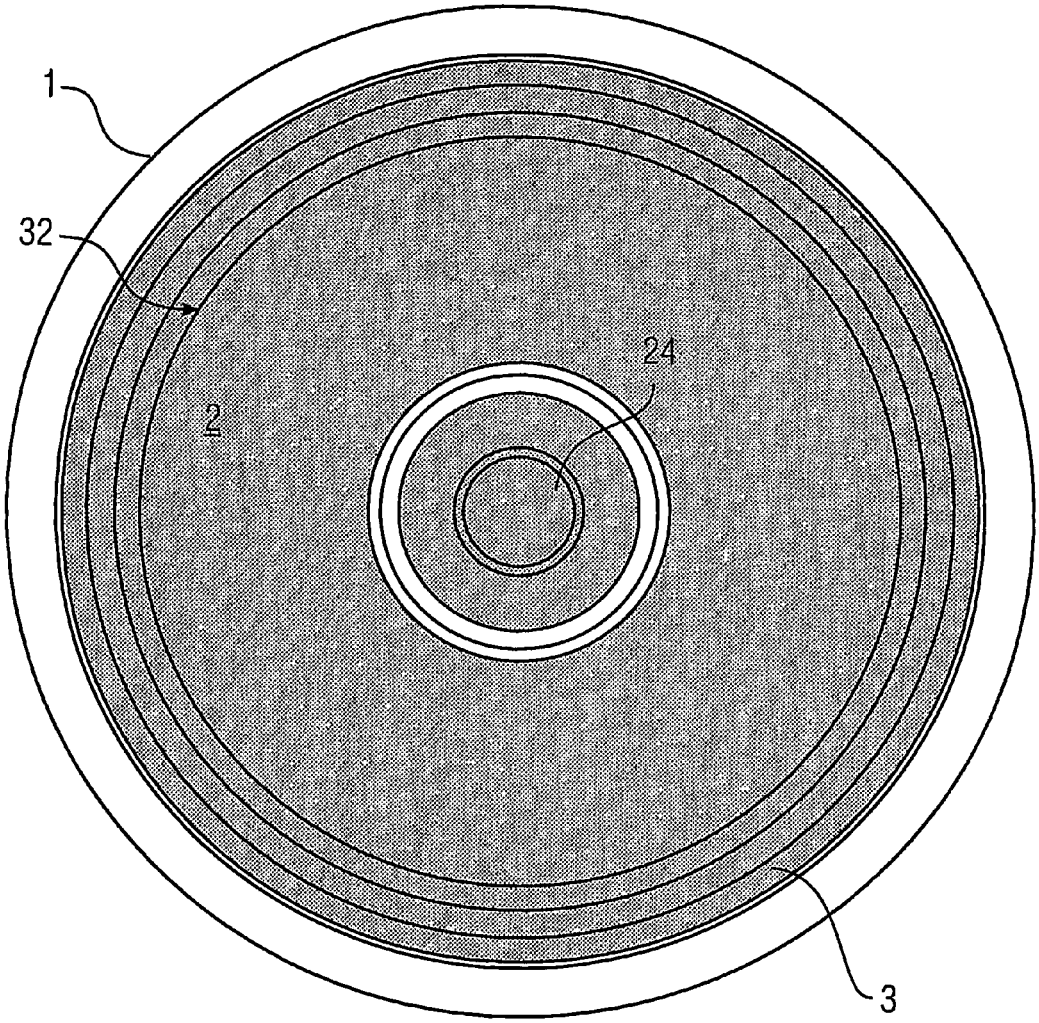

The invention will be explained in greater detail below with reference to preferred exemplary embodiments with the aid of the drawings, which show in detail:

FIG. 1 single-path speaker with a permanent magnet;

FIG. 2 single-path speaker with a permanent magnet and dust cap;

FIG. 3 variants of the membrane shape in the single-path speaker with a permanent magnet;

FIG. 4 single-path speaker with a permanent magnet and centering device in the form of a metal spring;

FIG. 5 single-path speaker with a permanent magnet and centering device made of cloth;

FIG. 6 double-path speaker with a permanent magnet and central tweeter;

FIG. 7 single path speaker with two permanent magnets;

FIG. 8 single path speaker with two permanent magnets and a dust cap;

FIG. 9 double-path speaker with three permanent magnets and a central tweeter;

FIG. 10 double-path speaker with three permanent magnets and a slightly conical basket;

FIG. 11 enlargement of the magnet system shown in FIG. 5;

FIG. 12 view of the basket from behind;

FIG. 13 frontal view of the membrane and central tweeter with screw holes on the edges;

FIG. 14 frontal view of the membrane and central tweeter without screw holes on the edges.

FIG. 1 shows a section of a simple broadband speaker embodied according to the invention with one single membrane 2 that is stretched over a flat basket 1 that is level on its rear side. The membrane 2 is attached to the basket 1 by a crimp 3 on its outer edge 32 and its outer edge 32 spans an outer edge plane 30. On the front side of the basket 1, a magnet system 4 is attached comprising a toric permanent magnet 5 having a pole flange 6 also in the shape of a ring on its front and having a pole flange 7 on its rear side that extends to a yoke 13. Between the yoke 13 of the rear pole flange 7 and the front pole flange 6, an air gap 8 is created into which the vibration coil 9, which is connected to the membrane 2 in the region 28, can protrude. In this manner, the membrane 2 can be caused to move and produce sound using electrical impulses in a known manner.

The preferred sound projection direction, which also defines the front of the speaker, is shown by the arrow 33. Moreover, the exterior diameter D of the membrane 2 and the smaller diameter d of the associated vibration coil 9 are shown on the right. According to the invention, in this embodiment, the magnet system 4 is moved significantly forward due to the arc of the membrane 2 and the nearby attachment of the vibration coil 9, such that the front pole flange 6 and the effective region of the yoke 13, which form the air gap 8, are located in front of the plane 30 of the outer edge of the membrane; the permanent magnet 5 is intersected by the plane 30 of the outer edge of the membrane. This allows for an extremely flat structure of the speaker.

It should also be noted that, in particular in the case of speakers with larger diameters, the permanent magnet 5 or the entire magnet system 4 may even be located completely in front of the plane of the outer edge of the membrane.

FIG. 2 shows a similar embodiment of a broadband single-path speaker; in this version, however, the membrane 2 has been replaced in a central region by a lighter, concave material 12. The replacement of the central portion of the membrane 2 with a lighter material has the advantage that the inactive mass of the membrane is reduced thereby and the usable frequency range of the speaker can be increased to higher frequencies.

FIG. 3 shows a further variation of a single-path system, similar to the embodiment according to FIG. 1. In this case, FIG. 3 has been divided into one upper and one lower variation of a membrane embodiment. The upper variant of the membrane embodiment shows a flat, conical membrane 2 that extends from the outer crimp 3 into the region of the vibration coil and then has a slightly concave form in its central region. In addition, the membrane has a centering device 20, which is embodied here as a metal spring. The lower parts of FIG. 3 show another form of the membrane 2 by way of example; it is planar for the most part in its edge regions, and subsequently has a slope with its maximum in the region of the vibration coil and is again concave in its central region.

FIG. 4 shows the same membrane contours again as FIG. 3, but the crimps 3 on the edges are provided with several wavy lines, while in FIG. 3 only one bump is provided for the crimp. Here, the centering device of the membrane 2 that is shown in FIG. 4 is, by way of example, made of a cloth material.

Another embodiment of the speaker according to the invention is shown in FIG. 5. This figure shows a section through a double-path speaker according to the invention, with the outer membrane 2 corresponding to the embodiment according to FIG. 2, but an additional tweeter has been integrated into the magnet system 4 in the central region. For this purpose, the magnet system from FIGS. 1 or 2 has been altered so that the rear pole flange has a second, central yoke 14 that forms a second air gap 15 along with the front pole flange 6. A second vibration coil 20, which activates a thin high-tone membrane 18, may protrude into this air gap. The high-tone membrane 18 is fastened on the front pole flange 6 of the magnet system 4 by way of a crimp 19.

FIG. 6 shows another modification of the double-path speaker according to the invention from FIG. 5; in this case, the two forms of the outer membrane 2 shown here correspond to the membrane variations shown in FIG. 3. However, due to the tweeter that is now arranged at the center of the magnet system, an additional flexible connection of the outer membrane 2 is made by means of another crimp 21 located on the inside, with the interior portion of this crimp 21 being attached to the front pole flange 6 of the magnet system 4. The embodiment of the magnet system in turn corresponds to the embodiment already shown in FIG. 5.

FIG. 7 shows another variation according to the invention of a single-path speaker. The form of the embodiment fundamentally corresponds to FIG. 1; the essential difference is in the magnet system. Here, instead of one single permanent magnet 5, an inner permanent magnet 5 as well as another, outer toric permanent magnet 22 are provided, with both permanent magnets having front pole flanges 6 and 23 between which the single air gap 8 is formed. With this structure, it is now possible to omit the rear pole flange that was shown in the magnet systems shown previously. The advantage of such an embodiment lies primarily in the fact that this structure allows for the structural height of the magnet system to be substantially reduced without reflux or, on the other hand, for a very large lift to be achieved with the same structural height.

FIG. 8 shows another sectional view of a single-path speaker having the same magnet system with two toric magnets as in FIG. 7, with the embodiment of the membrane being structured in such a way that a so-called "dust cap" is present in the central region, which reduces the inactive mass of the vibrating membrane.

Corresponding to the embodiments of the magnet system in FIGS. 7 and 8, FIG. 9 shows a further development of the invention with an additional tweeter arranged on the inside, with a third permanent magnet 25 with a front pole flange 26 being provided for the vibration coil of the tweeter and with the air gap for the vibration coil 17 of the tweeter 24 being formed between the central front pole flange 26 and the middle pole flange 23.

In contrast to the figures shown above, FIG. 10 shows a basket 1 whose rear side is not planar, but rather is embodied with an arc opposite the preferred sound direction of the speaker. This sort of gentle arc which, however, should have a maximum angle a of no more than 20°, preferably no more than 10°, preferably no more than 5°, can be helpful if a particularly flat embodiment of the speaker is necessary due to a special installation situation.

Fundamentally, the speaker shown here is comparable to the embodiment shown in FIG. 9, but it is necessary to mention that such a variation is also possible for all of the speakers shown above.

FIG. 11 shows an enlarged view of the magnet system from FIG. 6. This magnet system has a toric permanent magnet 5. On the rear side is a pole flange which is embodied on both sides before the first yoke 13 and a second yoke 14. On the front of the permanent magnet is another pole flange that, along with the first and second yokes, forms an air gap 8 and a second, inner air gap 15. A vibration coil 9, which is responsible for activating the outer membrane 2, extends into the outer air gap 8 while the vibration coil 17 of the tweeter 24 extends into the inner air gap 15. The tweeter is provided with a high-tone membrane 18 that has a small crimp 19 on its outer edge that is connected with the pole flange 6. In addition, FIG. 11 also shows the electrical connections 31 for the vibration coils, which are naturally present in every other speaker system but not explicitly shown. In the version shown, a damping element 27, which may be made of foam or soft rubber, for example, is preferably used in the central region of the magnet system.

The rear view of an exemplary speaker according to the invention is shown in FIG. 12. It essentially shows the basket 1 with the rear openings 10 in the basket 1, here arranged symmetrically, as well as the four screw holes 11. We would like to point out that other embodiments and contours of the openings would naturally lie within the scope of the invention as well. We especially emphasize that the speaker according to the invention need not have only a round outer shape, but rather that oval, rectangular, or any other known contours are possible as well.

FIGS. 13 and 14 show a top view of a double-path speaker according to the invention; for better visibility, the optional protective grate is not shown. FIG. 13 additionally shows four screw holes 11 for fastening the speaker while FIG. 14 shows an embodiment of the basket 1 without screw holes.

We would like to refer again to the fact that the speaker according to the invention, which operates according to the principle of the spring-mass system and as a dynamic speaker, i.e., has a vibration coil in the air gap of a permanent magnet, usually has a substantially larger vibration coil as compared to conventional systems and that the larger size of the vibration coil allows the magnet system to be positioned inside it.

This larger vibration coil has the further advantage that the membrane is activated farther toward its outer diameter. This stabilizes or substantially reduces the natural vibration behavior of the magnet and it can therefore have a substantially flatter, lighter, and thinner structure. Depending on the application and its size, the lift of the vibration coil lies between 0.5 and 20 mm +/− and its diameter is approximately 10 mm to 100 mm with a minimum winding height of approximately 1 mm.

In an exemplary embodiment of the speaker with an additional tweeter, the air gap for the outer membrane with its coil may be between 0.1 mm and 3 mm and the air gap selected for the coil of the tweeter would be correspondingly larger, between 0.2 and 4 mm. In so doing, the efficiency of the two systems may be adapted to one another. It is advantageous for the vibration coil for the tweeter to have the following dimensions: diameter of 6 mm to 50 mm, height from 0.1 to 10 mm +/−, and a lift of 0.1 to 5 mm +/−.

In addition, we would like to point out that the vibration coils used may be embodied with one or more coil layers, preferably with two layers, as well as with or without a mounting.

It is implicit that the features of the invention listed above may be used not only in the combinations mentioned, but also in any other combination or alone without departing from the scope of the invention.

Overall, therefore, the invention suggests a speaker system with an extremely flat structure that is distinguished by its particularly simple and, notwithstanding, very flat construction. Due to the use of the established plunger coil system, a high degree of effectiveness and high acoustical quality may be achieved for the speaker as well.

LIST OF REFERENCE CHARACTERS

1 Basket
2 Membrane
3 Crimp
4 Magnet system
5 Permanent magnet
6 Front pole flange
7 Rear pole flange with yoke
8 Air gap
9 Vibration coil
10 Opening
11 Screw holes
12 Dust cap
13 First yoke
14 Second yoke
15 Second air gap
16 Second membrane
17 Second vibration coil
18 High-tone membrane
19 Crimp for tweeter
20 Centering device
21 Second crimp of outer membrane 2
22 Second permanent magnet
23 Second front pole flange
24 Tweeter
25 third permanent magnet
26 Third front pole flange
27 Damping element
28 Fastening area for the first vibration coil
29 Protective grate
30 Plane of the outer edge of the membrane
31 Electrical connection
32 Outer edge of the membrane
33 Preferred sound projection direction
D Outer diameter of the outer membrane
d Diameter of the first vibration coil
T Installation depth of the membrane and magnet system
$\alpha$ Angle of the cone body to the level

The invention claimed is:

1. A broadband speaker, not a cone speaker, embodied as an electrodynamic sound converter, comprising at least 1.1 one first magnet (5), 1.2 one first membrane (2) with one membrane outer edge (32) that spans a membrane outer edge plane (30), 1.3 a first crimp (3) running around the circumference of the first membrane (2) for the flexible mounting for the first membrane (2), with the crimp being composed of a different material than the first membrane, 1.4 a first vibration coil (9) that is directly or indirectly attached to the first membrane (2), and 1.5 a magnet system (4) with at least one first magnet (5) and at least one first annular gap into which the first vibration coil protrudes and furthermore 1.6 a carrying construction (basket) (1) for housing the first magnet system (4) and the first membrane, with the first membrane being connected to the carrying construction by way of the first crimp and with the carrying construction having a front side oriented toward the membrane and a rear side oriented in the opposite direction, characterized in that 1.7 the first membrane (2) is constructed in one piece and at least partially toward the front in the direction of the preferred direction of the sound, in that said membrane has an arc, and in that the region (28) of the first membrane (2) to which the first vibration coil is attached, is disposed in front of the plane (30) of the outer edge of the membrane, with 1.8 the first membrane (2) having a diameter (D) that is greater than the diameter of the first vibration coil (d) that moves this membrane, 1.9 the first annular gap (8) having a narrowed parallel region in the direction of the membrane, and 1.10 the magnet system being disposed exclusively in front of the carrying construction (basket) (1).

2. The broadband speaker as recited by claim 1 above, characterized in that the magnet system (4) intersects with the plane (30) of the outer edge of the membrane.

3. The broadband speaker as recited by claim 1 above, characterized in that the magnet system (4) is disposed in front of the plane (30) of the outer edge of the membrane.

4. The broadband speaker as recited by claim 1 above, characterized in that the at least one further membrane (18) is disposed inside the first membrane (2).

5. The broadband speaker as recited by claim 4 above, characterized in that the magnet system (4) has at least one further annular gap (15) into which a further vibration coil (17) for a further membrane (18) may protrude, with this further annular gap (15) preferably having a narrowed parallel region in the direction of the membrane.

6. The speaker as recited by claim 4 above, characterized in that the first membrane (2) has a further crimp (21) on its interior by way of which it is connected to the magnet system (4).

7. The speaker as recited by claims 1 above, characterized in that the magnet system (4) has at least one toric magnet (5) and at least one pole flange (6), which form the at least one air gap (8).

8. The speaker as recited by claims 1 above, characterized in that the magnet system has several toric magnets (5, 22, 25), a rear pole flange (7), and one front pole flange (6, 23, 26) per magnet, with the air gaps (8, 15) being disposed between the pole flanges.

9. The speaker as recited by claim 4 above, characterized in that a centering device is attached to at least one membrane (2).

10. The speaker as recited by claim 1, characterized in that the magnets (5, 22, 25) are each surrounded by their respective vibration coil (9, 17) in the shape of a ring.

11. The speaker as recited by claim 1, characterized in that the magnet system (4) has pole flanges (6, 7, 23, 26) composed of a magnet material.

12. The speaker as recited by one of claim 1, characterized in that at least one toric magnet (22) is located at the same time inside one larger and outside one smaller vibration coil (9,17).

13. The speaker as recited by claim 1, characterized in that one toric magnet (5) has at least two pole flanges (6, 7) of which the rear pole flange (7) surrounds the magnet in the shape of a ring and forms one exterior and one interior air gap (8, 15) along with the front pole flange (6).

14. The speaker as recited by claim 1, characterized in that at least one magnet is composed of Neodym iron or Neodym iron-boron or rare earth cobalt ($SmCo_5$ or $Sm_2Co_{17}$) or hard ferrite.

15. The speaker as recited by claim 1, characterized in that at least one magnet is attached to the membrane basket at least by at least one screw and/or glue and/or at least one clamp element (Snap In, clipped).

16. The speaker as recited by claim 1, characterized in that at least one membrane is composed of foam material, preferably provided with a single- or double-sided boundary layer, preferably composed of aluminum and magnesium foam, hard polystyrol foam, PVC, polyolefin, polyurethane, polyester, Styrofoam, or sandwich plates with a honeycomb structure.

17. The speaker as recited by claim 1, characterized in that at least one membrane (2) is composed of specially formed films or sandwich products, preferably out of polyester, polyimide, bextrenes, polycarbonate, aluminum, magnesium, polypropylene, paper, fibrous material, carbon fibers, glass fibers, or mixed products of these materials.

18. The speaker as recited by claim 1, characterized in that an inversely formed dust cap (dome, cone, or anti-dust cone) (12) is disposed on one membrane (2).

19. The speaker as recited by claim 1, characterized in that at least one crimp (3, 19, 21) is composed of rubber or coated foam material, fibrous materials, or paper.

20. The speaker as recited by claim 1, characterized in that the basket (1) is produced from plastics or metallic materials.

21. The speaker as recited by claim 1, characterized in that the basket (1) has openings (10) for physically connecting it to the rear air supply, enclosure, or housing.

22. The speaker as recited by claim 1, characterized in that the rear of the basket (1) is flat.

23. The speaker as recited by claim 1, characterized in that the rear of the basket (1) is embodied as the base of a cone, preferably with a maximum slope of 20°, preferably with a maximum slope of 10°, to the level.

24. The speaker as recited by claim 1, characterized in that a protective grate (29) is provided in front of the membrane.

25. The speaker as recited by claim 1, characterized in that the ratio of B:T or D:T of the largest width B or diameter D of the outer membrane (2) of the speaker to the greatest depth T of the speaker construction with regard to the membrane and magnet system components is greater than 3:1, preferably greater than 5:1, preferably greater than 10:1.

26. The speaker as recited by claim 1, characterized in that at least one front pole flange (6, 23, 26) is disposed completely in front of the plane (30) of the outer edge of the membrane.

27. The speaker as recited by claim 1, characterized in that at least one permanent magnet (5, 22, 25) is disposed in front of the plane (30) of the outer edge of the membrane.

28. The speaker as recited by claim 1, characterized in that the magnet system (4) does not have a rear pole flange.

29. The speaker as recited by claim 1, characterized in that the outer crimp (3) has several bumps in its cross-section.

* * * * *